United States Patent [19]

Lanoue

[11] 4,345,804

[45] Aug. 24, 1982

[54] FLEXIBLE BUSHING CONNECTOR

[75] Inventor: Thomas J. Lanoue, Muncie, Ind.

[73] Assignee: Westinghouse Electric Corp., Pittsburgh, Pa.

[21] Appl. No.: 164,872

[22] Filed: Jul. 1, 1980

[51] Int. Cl.[3] ..... H01R 11/01; H01R 35/00

[52] U.S. Cl. ..... 339/9 E; 174/152 R; 336/105; 339/143 C

[58] Field of Search ..... 174/12 BH, 13, 18, 21 CA, 174/86, 99 E, 142, 143, 152 R, 153 R; 336/84 C, 105, 192; 339/6 R, 7, 9 R, 9 E, 64 R, 64 M, 143 R, 143 C

[56] References Cited

U.S. PATENT DOCUMENTS

| | | | |
|---|---|---|---|
| 891,343 | 6/1908 | Keller | 339/9 E |
| 1,759,567 | 5/1930 | Dibner | 339/9 E |
| 2,274,422 | 2/1942 | Mahoney et al. | 339/9 E X |
| 2,927,953 | 3/1960 | Staller | 339/9 E X |
| 3,325,588 | 6/1967 | Lear | 174/99 E X |
| 3,548,071 | 12/1970 | Bahen, Jr. et al. | 174/13 |
| 3,702,895 | 11/1972 | de Sio | 174/73 R X |
| 3,825,671 | 7/1974 | Pokorny | 174/127 X |

FOREIGN PATENT DOCUMENTS

| | | | |
|---|---|---|---|
| 904078 | 2/1954 | Fed. Rep. of Germany | 336/105 |
| 58160 | 7/1937 | Norway | 174/152 R |

*Primary Examiner*—Laramie E. Askin
*Attorney, Agent, or Firm*—L. P. Johns

[57] ABSTRACT

A high power flexible connector has a first conductive member adapted for connection to a bushing and a second conductive member adapted for connection to a winding. A plurality of flexible conductors connect the first member to the second member. Mechanically, the conductors provide for independent movement of the bushing with respect to the winding. Electrically, the cables provide a plurality of current paths and produce an electric field when carrying a current. The conductors are arranged such that the induced electric field is uniform.

5 Claims, 6 Drawing Figures

FLEXIBLE BUSHING CONNECTOR

BACKGROUND OF THE INVENTION

1. Field of the Invention

This invention relates generally to flexible connectors and more specifically to high power, 30,000 KVA and above, flexible connectors used to connect a winding to a bushing.

2. Description of the Prior Art

Electromagnetic apparatus such as transformers and electrical reactors may utilize any one of a wide variety of winding configurations. Examples include rectangular concentric windings, round concentric windings, and interleaved pancake windings. In addition to the various winding configurations different types of wire may be used in the winding. However, despite the large number of combinations of winding configurations and wire varieties there is a common feature in that there must be a means for connecting the finished winding to a bushing. The bushing serves as an interface between the outside world and the winding within the electrical apparatus. The bushing is subject to movement when exposed to external wind or short circuit forces. The movement of the bushing must not be transmitted to the winding.

A common method to effectuate a connection between the winding and the bushing is to use a short, heavy copper tube which is crimped so as to connect one end of a flexible lead wire to the winding. The other end of the lead wire is then connected to the bushing. If the lead wire has a diameter different from the diameter of the wire used in the winding, a tapered copper tube is used to connect one end of the lead wire to the winding. The other end of the lead wire is again connected to the bushing. In this manner, the winding is electrically connected to the bushing through a flexible lead wire which absorbs the motion of the bushing.

SUMMARY OF THE INVENTION

The present invention is a connector providing a flexible electrical connection between a winding lead and a bushing of a high power electromagnetic apparatus. The flexible connector has a first flat conductive ring adapted for connection to the bushing. A second flat conductive ring has a conductive plate connected thereto which is adapted for connection to the winding. A plurality of flexible, stranded, copper cables connect the first ring to the second ring. Mechanically, the cables provide for independent movement of the bushing with respect to the winding. Electrically, the cables provide a plurality of current paths and produce an electric field when carrying a current. The cables are arranged such that the electric field is uniform thus reducing the need for electrostatic shielding.

DESCRIPTION OF THE PREFERRED EMBODIMENT

Figure 1:
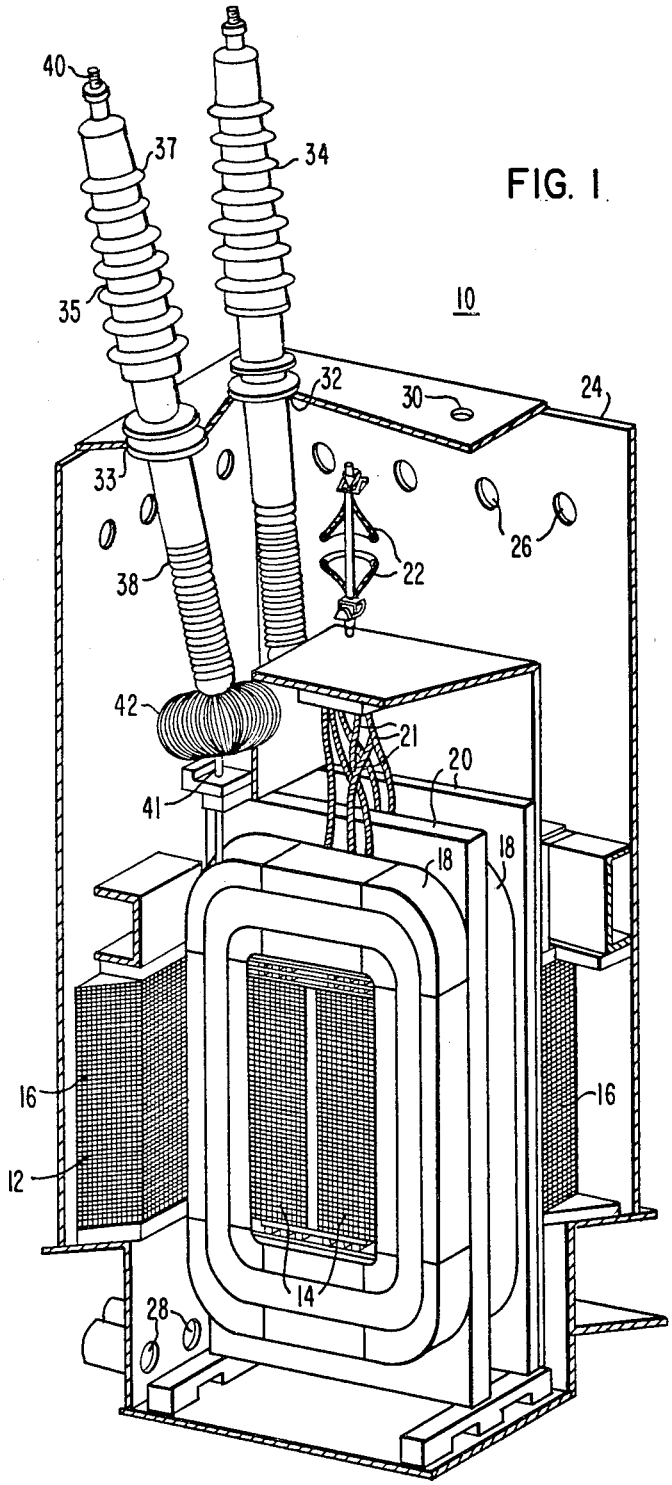
FIG. 1 illustrates the internals of a form fit, tap changing, power transformer utilizing the present invention to connect the high voltage windings to the bushings.

The present invention is illustrated in the environment of a tap changing power transformer 10 shown in FIG. 1. The following description of the transformer 10 is intended to provide an understanding of one environment in which the present invention is utilized. The transformer 10 is not a part of the present invention and is intended for purposes of illustration only. It is to be understood that the present invention may be utilized in other electromagnetic devices wherein a connector is needed to provide a connection between a winding and a bushing or other through electrical connector.

Turning now to FIG. 1, the power transformer 10 has a magnetic core 12 having center leg portions 14 and outer leg portions 16. The center leg portions 14 are surrounded by alternate layers of high voltage coils 18 and low voltage coils 20. Both the high voltage coils 18 and the low voltage coils 20 are surrounding by the outer leg portions 16 of the core. Lead wires 21 from the high voltage coils 18 are connected to a high voltage tap changing assembly 22. The transformer core 12, high voltage coils 18, low voltage coils 20, and the tap changing assembly 22 are enclosed within a transformer case 24.

The transformer case 24 is sealed to contain an insulating oil within the transformer. The transformer case 24 has outlets 26 around its upper portion to allow hot oil to be removed from the transformer and inlets 28 around its lower portion to allow cool oil to flow into the transformer. The transformer case 24 has an opening 30 for a low voltage bushing (not shown) and additional openings 32 and 33 for high voltage bushings 34 and 35, respectively, which extend therethrough. The high voltage bushing 35 has an upper porcelain section 37 and a lower porcelain section 38. The high voltage bushing 35 is connected at one end 40 to a high voltage line conductor (not shown). The high voltage bushing 35 is connected at the other end to a high voltage lead wire 41 of the high voltage coil 18 through a flexible connector 42 constructed in accordance with the teachings of the present invention. The high voltage bushing 34 is identical in structure and function to the high voltage bushing 35.

Figure 3:
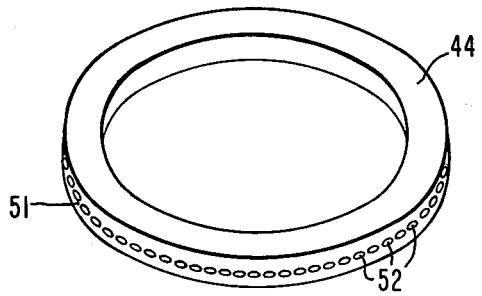
FIG. 3 is a perspective view of a circular ring of FIG. 2.
Figure 4:
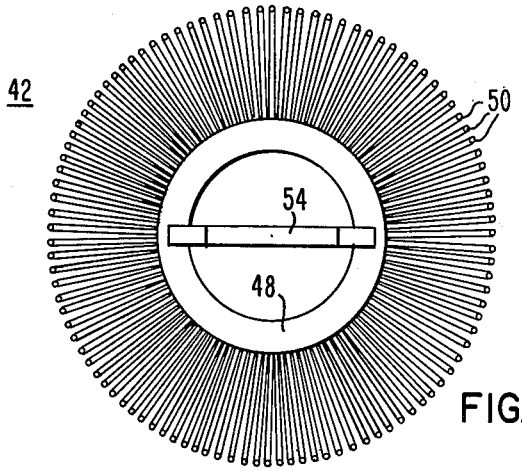
FIG. 4 is a top cross-sectional view of the present invention.

One benefit derived from the use of the flexible connector 42 is that movement of the bushing 35 due to wind, short circuit forces, or the like, is absorbed completely by the connector 42. Since the motion of the bushing 35 is not transmitted beyond the connector 42, the lead wire 41 may be connected directly to the connector 42. This direct connection eliminates the need for transitional connectors such as the copper tubes described earlier. The flexible connector 42 is described in detail in conjunction with FIGS. 2, 3 and 4 hereinafter. The dimensions given in conjunction with FIGS. 2, 3 and 4 are for an exemplary embodiment and will vary depending upon the specific application.

Figure 2:
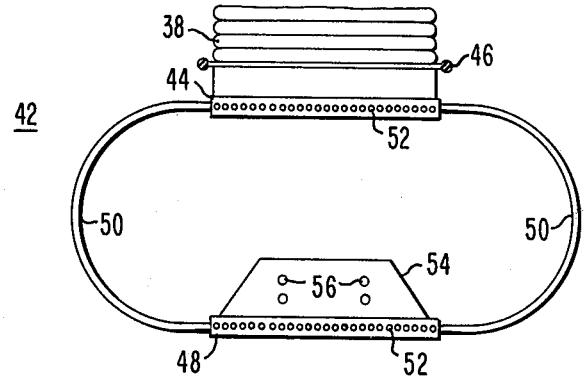
FIG. 2 is a side cross-sectional view of the present invention.

Turning to FIG. 2, a side cross-sectional view of the preferred embodiment of the flexible connector 42 is shown. The flexible connector 42 has a first conductive member 44 adapted for connection to the lower porcelain section 38 of the bushing 35. An insulating shielding ring 46 is located at the lower end of the lower porcelain section 38. In the preferred embodiment, the first conductive member 44 is a circular ring constructed of copper as shown in detail in FIG. 3. The ring 44 of FIG. 3 has an inside diameter of five inches (12.7 centimeters), an outside diameter of six and one-quarter inches (15.875 centimeters), and a thickness of one inch (2.54 centimeters). The edges of the ring 44 are rounded so as to have a one-eighth inch (0.3175 centimeters) radius. In the outer face 51 of the ring 44 a plurality of equally spaced holes 52 are drilled. Each hole is drilled to a depth of approximately one inch (2.54 centimeters) at a right angle to the edge of the ring 44. The bottom of each of the holes is flat and the outer edge of each of the holes is chamferred.

Returning to FIG. 2, a second conductive member 48 is identical to the first conductive member 44. The conductive members 44 and 48 are connected by a plurality of flexible conductors 50, of which two are shown in FIG. 2. The diameter of the holes 52 drilled in the conductive members 44 and 48 is such that the flexible conductors 50 will fit tightly into the holes 52. In the preferred embodiment, the flexible conductors 50 are stranded copper cables which each have one end brazed in place in one of the holes 52 of the first conductive member 44 and a second end brazed in place in one of the holes 52 of the second conductive member 48. The copper cables 50 may be insulated or uninsulated. The flexibility of the copper cables 50 determines the connector's 42 ability to absorb the motion of the bushing 35. Finally, the second conductive member 48 shown in FIG. 2 has a conductive plate 54 rigidly connected thereto and extending in a direction towards the first conductive member 44. The conductive plate 54 has holes 56 such that the lead wire 41 (shown in FIG. 1) may be connected thereto.

When all of the flexible conductors 50 are in place, the preferred embodiment of the flexible connector 41 has a toroidal configuration. FIG. 4 is a top cross-sectional view, looking downward, of the flexible connector 42. Shown in FIG. 4 is the second conductive member 48 and the conductive plate 54. The plurality of flexible connectors 50 extend upward from the second conductive member 48. It is anticipated that the flexible connector 42 will have a maximum diameter of approximately thirty inches (76.2 centimeters) and an axial length of approximately fifteen inches (38.1 centimeters). The flexible conductors 50 in addition to providing mechanical flexibility provide a plurality of current paths. When the flexible conductors 50 are carrying current, an electric field is induced. Since the flexible conductors 50 are equally spaced and uniform, the electric field induced is uniform thus minimizing the need for electrostatic shielding.

It is important to note that the conductive plate 54 is disposed within the toroidal configuration defined by the flexible conductors 50. The relatively large diameter of the toroid and the uniform positioning of the flexible conductors 50 provides an equipotential shield about the sharp edges of the conductive plate 54, the lead wire 41, and the connecting hardware (not shown) thus preventing the buildup of electrical stress which can ionize the surrounding insulating medium.

Figure 5:
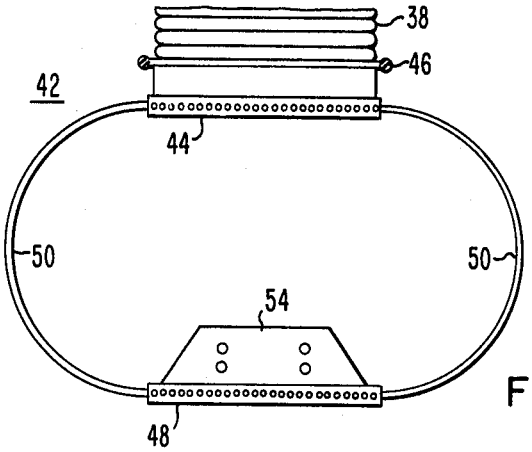
FIGS. 5 and 6 are side cross-sectional views illustrating alternative embodiments of the present invention.
Figure 6:
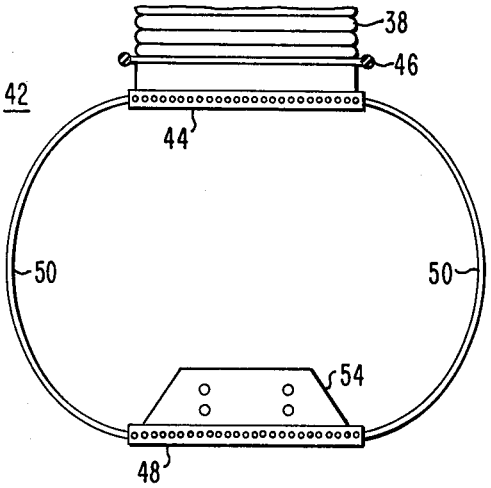

The toroidal configuration and the dimensions discussed hereinabove are intended to be illustrative of the preferred embodiment. Other embodiments of the present invention include flexible connectors having a spherical or ellipsoidal configuration as shown in cross-section in FIGS. 5 and 6, respectfully. It is therefore anticipated that flexible connectors may be constructed according to the teachings of this invention which are not of a toroidal configuration and which have dimensions that vary from those given herein but nevertheless fall within the scope of the present invention.

What is claimed is:

1. A connector for providing a flexible electrical connection between a winding lead of a winding and a through electrical conductor of a bushing, comprising:

a first conductive member adapted for connection to the through electrical conductor;

a second conductive member;

a plurality of flexible conductors connecting said first conductive member to said second conductive member for mechanically absorbing the motion of said through electrical conductor and for electrically providing a plurality of current paths, said flexible conductors being symmetrically arranged such that a uniform electric field is produced when said flexible conductors are carrying current;

a connecting member carried by said second conductive member and adapted for connection to said winding lead, said connecting member being located within a plurality of flexible conductors; and said flexible conductors constituting the only current-carrying conductors connecting said first and second conductive members.

2. The connector of claim 1 wherein the first conductive member includes a first flat conductive ring having a plurality of holes in its outer face each receiving a flexible conductor and wherein the second conductive member includes a second flat conductive ring having a plurality of holes in its outer face each receiving a flexible conductor.

3. The connector of claim 1 wherein the plurality of flexible conductors includes a plurality of stranded copper cables.

4. The connector of claim 1 wherein the flexible conductors are insulated.

5. The connector of claim 1 wherein the plurality of flexible conductors are arranged in a toroidal configuration.

* * * * *